US006588593B2

(12) United States Patent
Woskoski

(10) Patent No.: US 6,588,593 B2
(45) Date of Patent: Jul. 8, 2003

(54) FLUID CONTAINER WITH TIMEPIECE

(76) Inventor: Steven M. Woskoski, 6412 N. Anna Ave., Fresno, CA (US) 93710

( * ) Notice: Subject to any disclaimer, the term of this patent is extended or adjusted under 35 U.S.C. 154(b) by 0 days.

(21) Appl. No.: 09/829,297

(22) Filed: Apr. 9, 2001

(65) Prior Publication Data

US 2002/0144914 A1 Oct. 10, 2002

(51) Int. Cl.[7] ..... B65D 85/00; G04B 47/00

(52) U.S. Cl. ..... 206/459.1; 206/217; 222/243; 368/10; 215/100 R

(58) Field of Search ..... 206/459.1, 217; 368/10, 89.95, 278; 222/30, 28, 640; 215/100 R; D7/507, 509

(56) References Cited

U.S. PATENT DOCUMENTS

| | | | | | |
|---|---|---|---|---|---|
| 2,895,636 | A | * | 7/1959 | Martin | 220/574 |
| D185,991 | S | * | 8/1959 | Loewy | D9/337 |
| 3,845,883 | A | * | 11/1974 | Johnson et al. | 222/30 |
| 4,034,757 | A | * | 7/1977 | Glover | 222/30 |
| 4,054,026 | A | * | 10/1977 | Goodrich | 368/93 |
| 4,794,578 | A | * | 12/1988 | Leo | 368/316 |
| D314,308 | S | * | 2/1991 | Cogswell | D7/507 |
| 5,000,581 | A | * | 3/1991 | Yata et al. | 215/11.2 |
| 5,181,189 | A | * | 1/1993 | Hafner | 368/10 |
| 5,201,431 | A | * | 4/1993 | Berger et al. | 215/100 R |
| D358,964 | S | * | 6/1995 | Foster et al. | D7/510 |
| 5,457,665 | A | | 10/1995 | Reid | |
| 5,529,217 | A | * | 6/1996 | Siegel | 22/231 |
| 5,751,660 | A | * | 5/1998 | Chappell | 368/10 |
| 5,953,288 | A | * | 9/1999 | Chappell | 368/10 |
| 6,324,123 | B1 | * | 11/2001 | Durso | 368/10 |

* cited by examiner

*Primary Examiner*—Bryon F. Gehman
(74) *Attorney, Agent, or Firm*—Richard A. Ryan

(57) ABSTRACT

A fluid container having a timepiece incorporated into or attached to the body of the container for holding liquids in the container and displaying various time functions from the timepiece. The fluid container can be of a variety of styles, shapes and sizes, including bottles, jugs and cups. A removable, sealable cap portion can attach to the fluid container to seal the fluid therein. Straws, pop-up mechanisms and other apparatuses for withdrawing fluid from inside the fluid container can be used. The timepiece can be located anywhere on the container body and can display the time of day, elapsed time, date and similar time information. The timepiece can also include a stopwatch function.

12 Claims, 4 Drawing Sheets

FLUID CONTAINER WITH TIMEPIECE

BACKGROUND OF THE INVENTION

1. Field of the Invention

The field of the present invention relates generally to devices that combine containers for holding water or other liquids with timepieces used to indicate the time of day, elapsed time, date and other useful information. More specifically, the present invention relates to such containers that incorporate the timepiece into or onto the wall of the container. Even more specifically, the present invention relates to water and other beverage containers that incorporate a timepiece into the container.

2. Background

Many people commonly utilize re-useable, closeable containers for storing liquids for later consumption. Typical containers include plastics bottles, plastic jugs and other such containers. One common configuration for containers for storing liquids is the "water bottle" type of container. Typically, these containers have a sealable lids or bottle tops that can be removed for filling the container or for drinking fluids therefrom. For ease in drinking liquids from these type of containers, they typically utilize either a removable cap or lid portion that is removed to drink the liquid from the container, a pop-up apparatus in the cap or lid portion that allows the user to drink liquid through the cap or lid portion, or an elongated straw or straw-type device that is inserted into the container through the cap or lid portion to allow the fluid to be withdrawn from the container. These fluid containers are sold in several different ways. One way is to sell the container alone, separate from any liquid beverage, such that the consumer can fill the container with the liquid beverage of his or her choice. Another way these containers are commonly sold is with a particular liquid beverage already inside the container.

Liquids commonly utilized with the above-described containers include such beverages as water, thirst quenchers (i.e., Gatorade® and others), soda drinks, fruit drinks and other beverages. Many people utilize the beverage-filled containers as part of their work, sport or play activity to provide them with liquid refreshment when they get thirsty from their activity. A common configuration is the "sports bottle" container that is filled or which can be filled with water or a thirst quencher fluid. These typically have a cap with a pop-up nozzle or a lid with a pop-up funnel portion that allows the user to withdraw the liquid from inside the container. The popularity of this type of container for these liquids is due in part to the ease in which they can be opened and closed to get fluid to or from the inside of the container and because they close so as to prevent spillage of the fluid if the container is knocked over. As such, many people carry this type of container (with the desired fluid inside) while they work or while the are engaged in sport or play activity.

It is well known that proper hydration of the body is very important for good health and to avoid heat stroke and dehydration related problems. While it is obvious to most people that there is a need for proper and sufficient hydration in the warmer climate areas, the colder climate areas also require proper hydration to avoid problems with hypothermia and the like. Because of the problems with proper hydration, it is widely recommended that people drink water or other appropriate fluids on a regular basis throughout the day, particularly those persons who are most acceptable to heat and/or dehydration related problems. Typically, this requires drinking water before the thirst reflex is telling the body that it needs more fluids. Once a person becomes thirsty, some level of dehydration has already set in. The need to maintain proper hydration (as opposed to just responding to thirst) is especially true of those who work or play in the outdoors, whose work or other activity involve significant physical activity (i.e., lifting, bicycling, running, etc.) and those who have health-related reasons for maintaining proper hydration. Various sport, health and employer groups have developed recommended guidelines for maintaining proper hydration that identify suggested intervals for drinking fluids. Some weight loss programs require or suggest that the person on the program do his or her best to maintain a regular schedule of drinking fluids. In addition, certain medicines must be taken with fluids at the same time each day or at regular intervals.

The typical difficulty with scheduling drinking times is being able to remember when to drink the fluids. Persons who work indoors or other areas where clocks, water fountains and beverage vending machines are readily available typically do not have problems with maintaining proper hydration levels. Those who work outside and who are engaged in strenuous work or play activities generally do not have this ease of access to clocks or water supplies. This is particularly the case in ceratin jobs where it is difficult to either carry around water or, as is often the case, where it is either difficult or unsafe to wear a wristwatch. For instance, those involved in construction, delivery (i.e., mail or package carriers) or other physically strenuous or assembly line-type (i.e., those with moveable gears, etc.) jobs often are not allowed to wear or are strongly counseled against wearing a wristwatch due to the potential for the watch to be caught on something and damage the watch or, worse yet, injure the person wearing the watch. However, these people tend to be those who are most in need of regular fluid intake.

One way in which some people attempt to be able to ensure they are drinking fluids on a regular basis is to attach a wristwatch or other timepiece to a container suitable for holding liquids. The wristband can go around the bottle and clamp the watch to the bottle. In the alternative, tape or other adhesives can be used to attach a timepiece to the container. However, this has several disadvantages that limits the usefulness of this watch/bottle system. One is that the watch may be too expensive to leave attached to a water bottle container or the size of the watch or other timepiece may be such that it does not easily fit onto the container, making it impractical and/or too difficult to utilize. It can be appreciated, therefore, that what is needed is a container suitable for holding liquids therein and having a timepiece thereon for indicating time information. The container/timepiece combination should be suitable for use as a drinking container and for indicating to the user the time of day and/or intervals between required or desired times for drinking fluid from the container.

SUMMARY OF THE INVENTION

The fluid container with timepiece of the present invention solves the problems and provides the benefits identified above. That is to say, the fluid container with timepiece of the present invention provides a container suitable for holding fluids therein and having a timepiece incorporated thereon. The fluid container of the present invention allows the user to carry and drink desired fluids on a regular basis by having the timepiece incorporated into the wall of the container itself without having to rely on a wristwatch or other timepieces. In the preferred embodiment of the present invention, the fluid container is of the sports bottle-type and includes a timepiece member that indicates both the time of day and has an elapsed time indicator for monitoring the amount of time between drinks from the container.

According to one aspect of the present invention a fluid container with timepiece is provided comprising a fluid container having a container body suitable for storing a fluid, such as water, thirst quencher, fruit juice or other liquids, therein and a timepiece attached to the container body, the timepiece having a mechanism for displaying time, such as hands, digital numbers or the like. In the preferred embodiment, the fluid container can have a cap portion that is removably attached to the top of the container body to enclose the fluid in the container body. The cap portion can comprise a mechanism for allowing the user to withdraw the fluid from the container through the cap. The container body can be generally tubular shaped and made out of plastic or other materials that are generally unbreakable and lightweight. The timepiece can also include an elapsed time indicator to indicate to the user the time between drinking intervals. The timepiece can be removable from the container body to allow the user to replace batteries or repair/replace the timepiece as needed. The timepiece can be molded into the body of the container and covered with a film or sheet of transparent plastic or other material to protect the timepiece. In one embodiment, the fluid container is a sports bottle or jug type of container. In an alternative embodiment, the fluid container is a cup, such as a coffee cup type container.

According to another aspect of the present invention, the fluid container has a container body suitable for storing a fluid therein and a cap portion removably attached to the top of the container body to enclose the fluid in the container body so as to prevent spillage. The fluid container can have a cavity in the container body that is sized and configured to accept a timepiece therein. The timepiece can snap or otherwise lock into the cavity so as to securely attach the timepiece to the fluid container. As above, the timepiece has a mechanism for displaying time and/or elapsed time. The timepiece can be removable from the cavity if desired, or it can be molded into the cavity to form a single unit.

Accordingly, the primary objective of the present invention is to provide a fluid container with timepiece that includes a container for holding fluid that has a timepiece incorporated therein. It is also an important objective of the present invention to provide a fluid container that includes a timepiece that is able to display the time of day, elapsed time, date and/or other time/date features. The above and other objectives of the present invention will be explained in greater detail by reference to the attached figures and the description of the preferred embodiment which follows. As set forth herein, the present invention resides in the novel features of form, construction, mode of operation and combination of elements presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
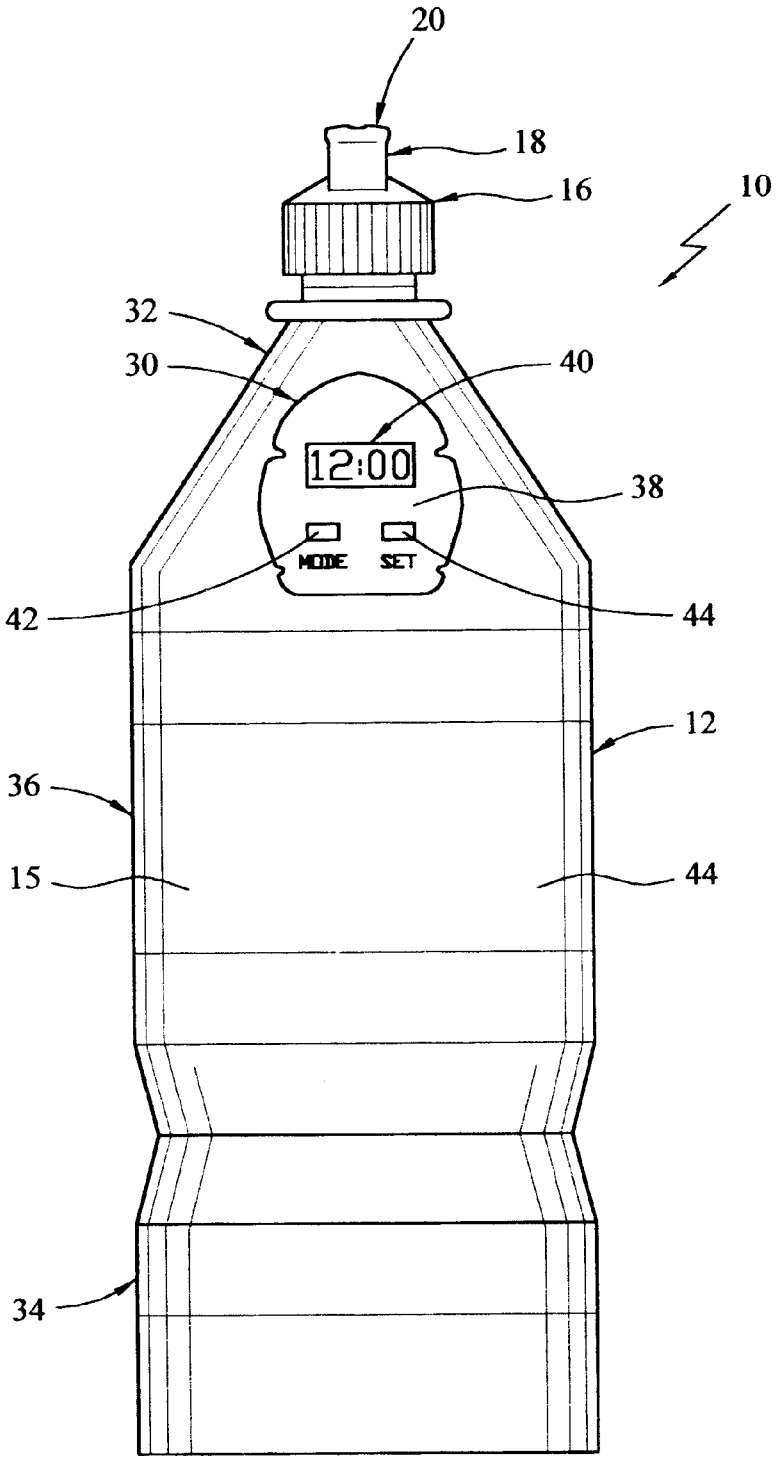
FIG. 1 is a side view of an exemplary water bottle incorporating a timepiece in accordance with one embodiment of the present invention.

With reference to the figures where like elements have been given like numerical designations to facilitate the reader's understanding of the present invention, and particularly with reference to the embodiments of the present invention illustrated in the accompany figures, the preferred embodiments of the present invention, designated generally as 10, are set forth below utilizing exemplary water bottles and an exemplary cup as set forth below. The exemplary fluid container 12 shown in FIG. 1 is of the type utilized by some purveyors of speciality waters and sport drinks that sell the bottle with beverage and which is sold empty to be filled by the user with his or her favorite drink. Fluid container 12 has a generally tubular container body 14 with an elongated cylindrical wall 15 and a removable cap portion 16 on top of body 14. Cap 16 has threads that match threads on the top of body 14 so that it can be removed from body 14 to allow the user to withdraw fluid, such as water, thirst quencher, fruit juice and other beverages, from inside container 12 or put fluid into container 12 for later withdrawal. Cap 16 shown in FIG. 1 is of the type that has a pop-up portion 18 that is pulled out to open the passageway between the interior of container 12 and hole 20 for the user to drink the fluid.

Figure 2:
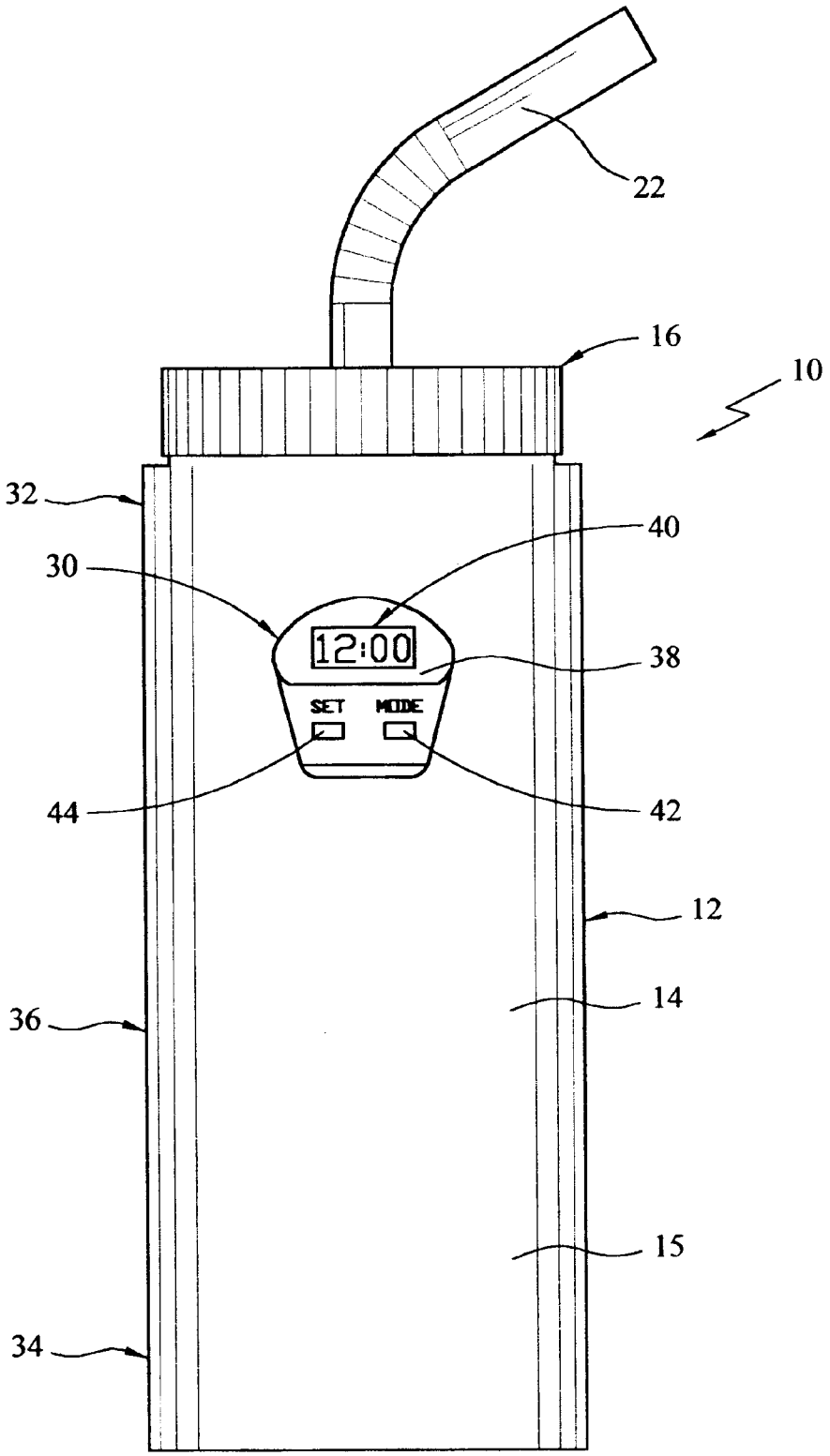
FIG. 2 is a side view of another exemplary water bottle incorporating a timepiece in accordance with one embodiment of the present invention.
Figure 3:
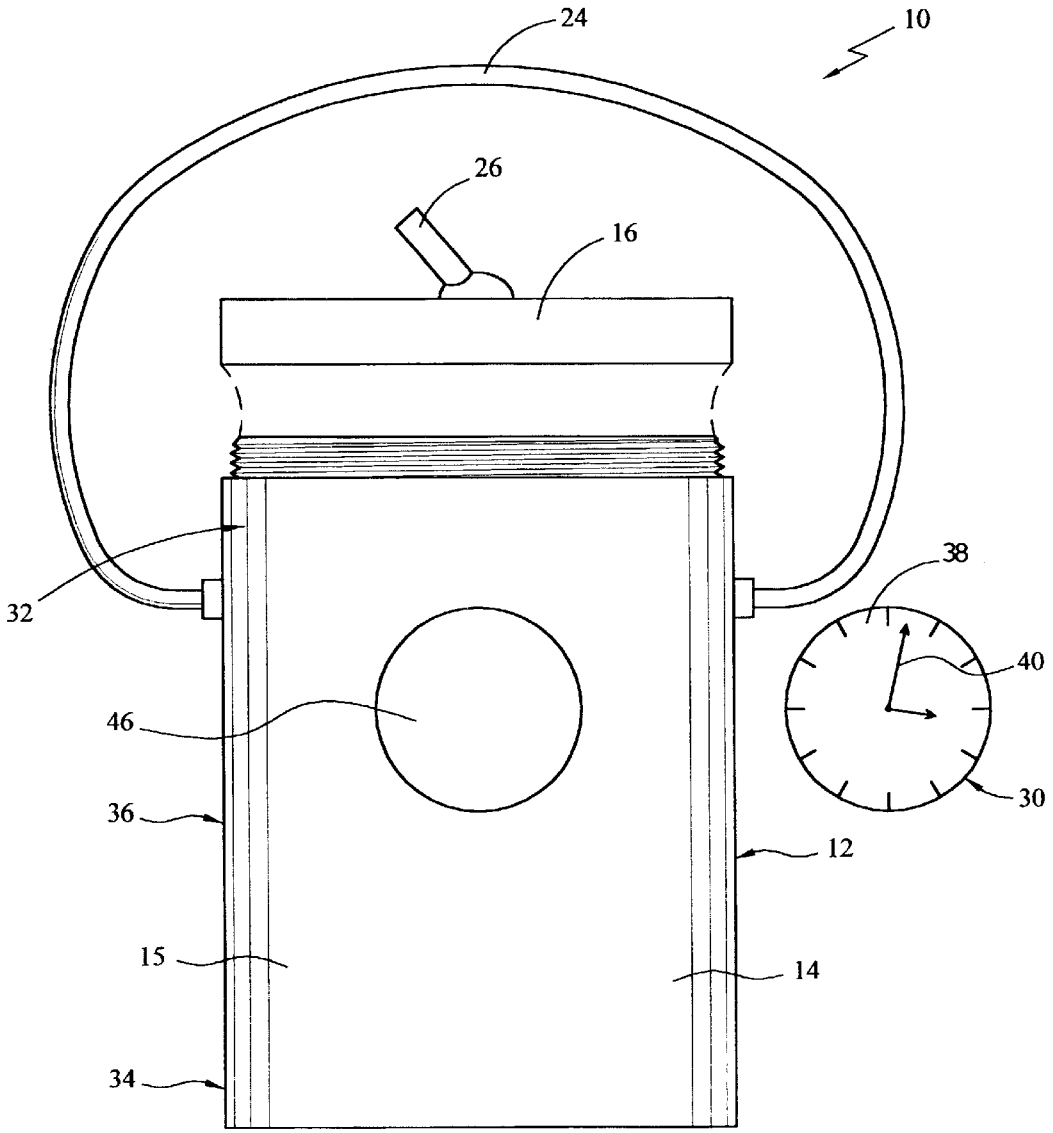
FIG. 3 is an exploded view of an exemplary water jug incorporating a timepiece in accordance with one embodiment of the present invention.
Figure 4:
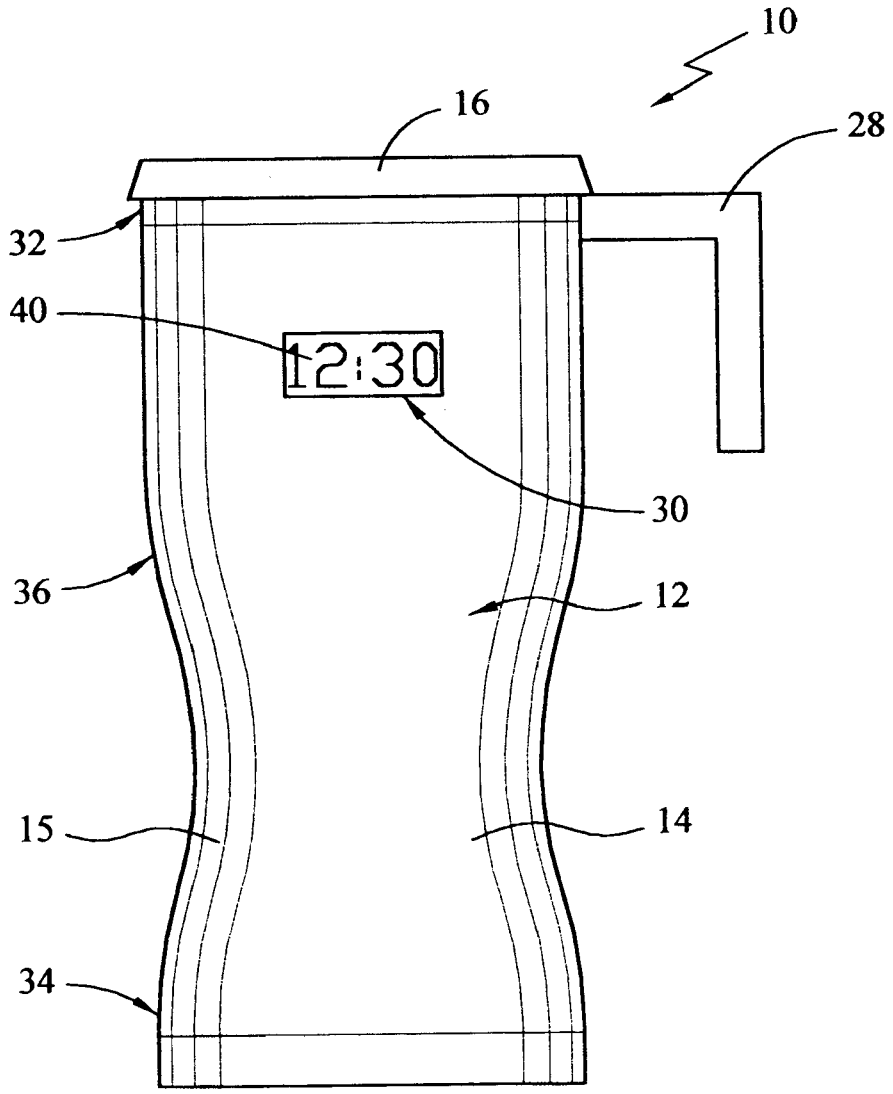
FIG. 4 is a side view of an exemplary cup incorporating a timepiece in accordance with one embodiment of the present invention.

Fluid container 12 can be of a variety of shapes, further examples of which are shown in FIGS. 2 through 4. A number of other shapes are also well known as fluid containers. The fluid container 12 shown in FIG. 2 has a relatively large screw-on/off cap portion 16 that provides a body 14 with a wide-mouth opening at the top. A straw 22 is disposed through cap portion 16 and into the fluid inside container 12 so the user of fluid container 12 can drink the fluid inside without removing cap 16. Typically, straw 22 includes a straw cap (not shown) at the open end of straw 22 to prevent the fluid inside container 12 spilling out. Fluid container 12 shown in FIG. 3 is a water jug style that typically is of a larger size and that has a larger top opening that cap 16 attaches (usually by a threaded connection). The typical water jug has a handle 24 for carrying and a pop-up drinking portion 26 in cap 16 that closes off the fluid flow passageway when in the down position to prevent spillage of the fluid inside container 12 and which allows the user to drink fluid from the inside of container 12 through that passageway when in the up position. The fluid container 12 in FIG. 4 is configured like a cup, having cup handle 28 for drinking fluids from container 12. Typically, these types of containers 12 have a closeable cap 16, often with either a straw hole or a drinking hole (not shown) to allow the user to withdraw fluids (including hot fluids such as coffee and hot chocolate) from inside container 12. Typically, cap 16 on container 12 as in FIG. 4 will be of the snap-type that engages body 14 when pressed downward on body 14. The various containers shown in FIGS. 1 through 4 can also include straps or other mechanisms for carrying the container 12. Although a variety of containers are shown in FIGS. 1 through 4, these containers are only intended to be exemplary of the types of containers suitable for the present invention 10.

Fluid container 12 shown in FIG. 1 has timepiece 30 incorporated into container body 14 near the upper end 32 of container 12. Although shown near upper end 32 in FIG. 1, timepiece 22 can be located near lower end 34 or middle 36 of body 14, as preferred by the manufacturer or dictated by the configuration of body 14. Timepiece 30 comprises a timepiece body 38 having a display panel 40, which can be a digital display as shown in FIGS. 1, 2 and 4, a standard dual hand display as shown in FIG. 3 or other types of time display as commonly known and available. The timepiece 30 shown in FIG. 1 also has a mode button 42 for changing the time display in display panel 40 to a date, stopwatch or other function and a set button 44 to allow the user to set a different time or date. Timepiece 30 can include a stopwatch or countdown timers that can keep track of the elapsed time (as shown in FIG. 2) between drinks from fluid container 12.

An alarm, such as a ring or bell, can be used to indicate the time when the user should drink more fluids from container 12 so as to avoid dehydration problems. Timepiece 30 can also include a button, switch or other mechanism for activating a light within timepiece 30 that allows the user to see what time it is at night or other low light conditions. The timepiece 30 used with the present invention 10 can be powered by mechanical mechanism (i.e., winding or self-winding apparatus) or by use of batteries, solar power or other well known and commonly available methods of supplying power to timepiece 30.

Fluid container 12 can be made out of a variety of inexpensive and readily available materials, such as plastic and like materials. Although other materials can also be used, the material should be relatively strong, crush and break resistant, suitable for storing a variety of fluids and lightweight enough to easily carry. Timepiece 30 can be made out of plastics, metals and a variety of other materials that are sufficiently resistant to exposure to air, water and environmental conditions and damage from contact against the ground, other bottles or other objects. Timepiece 30 can be mounted against body 14 and attached to body 14 utilizing adhesives (i.e., various glues), connectors (i.e., screws) and/or brackets. The preferred embodiment of the present invention 10 has timepiece 30 inset into a cavity 46 (an example of which is shown in FIG. 3) in body 14. Body 14 can be molded to include cavity 46 in wall 15" after the text at the desired location for timepiece 30 and configured such that timepiece 30 can snap or lock into cavity 46 to form the present invention 10. Alternatively, timepiece 30 can be molded into and as part of body 14. Timepiece 30 should sufficiently attach or connect to body 14 such that timepiece 30 will not jar loose from or fall out of the cavity or off the exterior of body 14 during the expected usage of the present invention. This usage could include the container 12 being dropped or thrown by the user and being hit or kicked by a ball or player (whether purposefully or not). The present invention 10 can include the feature of allowing timepiece 30 to be removed from container 12 so that the user may repair or replace the timepiece as needed or to replace the batteries as necessary. If desired to further protect timepiece 30, a film or sheet of transparent plastic or other covering material (not shown) can be placed over timepiece 30 to prevent scratching or other damage to timepiece 30. The covering material can either be fixed to the container body 14 or it can be removable to allow access to timepiece 30.

In use, the present invention 10 is provided in the form of a fluid container 12 having a timepiece thereon or therein. After the user purchases or is given the present invention, he or she would insert batteries (if needed) and utilize the mode 42 and set 44 buttons to set the correct time and other information which may be pertinent to the timepiece and the individual's needs (i.e., the date function, any time interval settings, etc.). The container 12 is filled with water or one of the other available fluids that appeals to the user and container 12 is resealed to prevent unplanned loss (i.e., spillage) of fluid from container 12. The user then can carry the present invention 10 as he or she goes through their planned activities, whether that be job, sport, recreational or the like. When the user is thirsty or when the time interval is appropriate to avoid dehydration, he or she would drink from container 12 an amount of fluid necessary depending on the circumstances. The interval settings of timepiece 30 can be set to remind the user when to drink fluids to maintain proper hydration or when it is necessary to take prescribed medication. The timepiece 30 will also indicate to the user the time of day so that he or she can know what time it is in case of appointments or other reasons to have to be somewhere at a certain time.

In an alternative embodiment of the present invention, the fluid container 12 could have multiple timepieces 30 therein or thereon for different uses or times. For example, one timepiece can be used for the actual time of day and the other timepiece can be used as a stopwatch or countdown timer. In another configuration, one timepiece 30 could be set on the user's time while the other timepiece is set to the time at another location (i.e., different time zone or country). In another alternative embodiment, the fluid container 12 can be a coffee cup or mug type container that does not include a sealable cap or lid 16. As with the above, the timepiece 30 can keep time and keep track of intervals for drinking fluids or taking medication.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A fluid container for drinking liquids therefrom, comprising:

a tubular container body having an elongated circumferential wall;

a timepiece attached to said container body, said timepiece having means thereon for displaying the current time of day, said displaying means having an elapsed time indicator; and a cap portion removably attached to the top of said container body.

2. The fluid container of claim 1, wherein said cap portion is threadably attached to the top of said container body.

3. The fluid container of claim 2 further comprising a means for drinking liquid from inside said container body through said cap portion.

4. The fluid container of claim 1, wherein said container body is generally cylindrical.

5. The fluid container of claim 1, wherein said fluid container is a cup.

6. The fluid container of claim 1, wherein said timepiece is removable from said container body.

7. The fluid container of claim 1, wherein said timepiece is molded into said container body.

8. The fluid container of claim 1, wherein said container body comprises a cavity therein, said timepiece positioned in said cavity.

9. A fluid container for drinking liquids therefrom, comprising:

a tubular container body having an elongated circumferential wall, said container body having a cap portion threadably attached to the top of said container body;

a cavity in said wall of said container body; and a timepiece in said cavity, said timepiece having means thereon for displaying the current time of day, said displaying means having an elapsed time indicator

10. The fluid container of claim 9, wherein said timepiece is removable from said container body.

11. The fluid container of claim 9, wherein said timepiece is molded into said container body.

12. The fluid container of claim 9 further comprising a means for drinking liquid from inside said container body through said cap portion.

* * * * *